United States Patent [19]

White, Jr.

[11] Patent Number: 4,875,841

[45] Date of Patent: Oct. 24, 1989

[54] STAGGERED ROTOR GEROTOR DEVICE

[76] Inventor: Hollis N. White, Jr., 243 Pyle La., Hopkinsville, Ky. 42240

[21] Appl. No.: 304,924

[22] Filed: Feb. 1, 1989

Related U.S. Application Data

[63] Continuation of Ser. No. 77,869, Jul. 27, 1987, abandoned.

[51] Int. Cl.[4] ..... F03C 2/08

[52] U.S. Cl. ..... 418/60; 418/61.3

[58] Field of Search ..... 418/60, 61 B

[56] References Cited

U.S. PATENT DOCUMENTS 3,106,163 10/1963 Mosbacher ..... 418/61 B
3,549,282 12/1970 Woodling ..... 418/60
3,687,578 8/1972 White, Jr. et al. ..... 418/61 B
3,922,120 11/1975 McCullough et al. ..... 418/60
4,493,622 1/1985 Miller ..... 418/60

FOREIGN PATENT DOCUMENTS 1121499 10/1984 U.S.S.R. ..... 418/60

*Primary Examiner*—John J. Vrablik
*Attorney, Agent, or Firm*—Woodling, Krost and Rust

[57] ABSTRACT

A device having two gerotor structures, each having a rotor oriented with a certain neutral phase relationship in respect to its stator, is disclosed having the neutral phase relationship of one gerotor structure being different in respect to the neutral phase relationship of the other gerotor structure so as to even the torque output of the device.

17 Claims, 4 Drawing Sheets

STAGGERED ROTOR GEROTOR DEVICE

This is a continuation of co-pending application Ser. No. 77,869 filed on July 27, 1987, abandoned.

FIELD OF THE INVENTION

This invention relates to an improved staggered rotor gerotor device.

BACKGROUND OF THE INVENTION

Gerotor hydraulic devices are becoming more and more common place. In addition to the archtypical agricultural operations such devices are now also found in industrial applications such as robots and mechanized transportation equipment. With these increasing numbers of applications certain, previously ignored, inherent operating characteristics are beginning to intrude. Examples include uneven torque and power limitations. Present attempts to remedy these characteristics, such as increasing the number of gerotor cells or the size of the devices, are not efficient in either cost or practicality. The present invention is directed towards providing a more practical, cost-effective higher and smoother torque gerotor device.

SUMMARY OF THE INVENTION

The present invention is directed towards providing a gerotor device having a smooth, even torque.

It is an object of this invention to equalize the torque of the device throughout its entire 360 degree rotation.

It is an object of this invention to increase the torque of gerotor devices.

It is an object of this invention to increase the longevity of gerotor devices.

Other objects and a more complete understanding of the invention may be had by referring to the following specification and drawings in which:

DESCRIPTION OF THE PREFERRED EMBODIMENT

Figure 1:
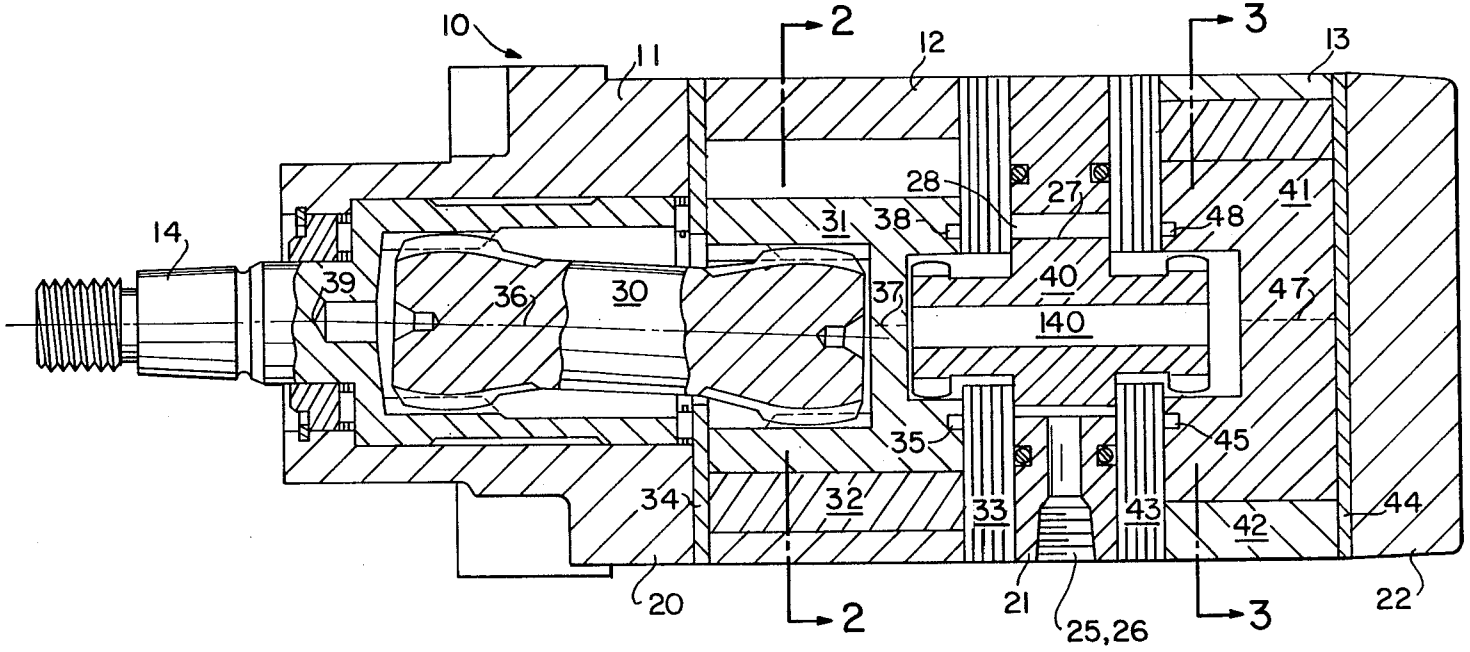
FIG. 1 is a central longitudinal cross-sectional view of a gerotor motor incorporating the invention of the application.

The invention of this present application relates to a staggered rotor gerotor device 10. The preferred device includes a housing 11, two gerotor structures 12, 13 and a drive shaft 14.

The housing 11 is a steel structure some 12" in length. The housing 11 includes a front mounting and bearing member 20, an intermediate porting member 21 and an end plate 22. The front member 20 is designed to mount the device 10 onto any associated mechanism and to retain the drive shaft 14 in place against loads including radial side loads. The intermediate porting member 21 is designed to proved a single, heavy unitary plate for the fixed connection of tubing to the input and discharge ports 25, 26 for the device 10. The end plate 22 is designed to terminate the device 10.

Each gerotor structure 12, 13 includes a wobblestick 30, 40; a rotor 31, 41; a stator 32, 42; a manifold plate 33, 43; and a balancing plate 34, 44.

The wobblesticks 30, 40 are each sized for their application.

The lead wobblestick 30 is the main angular drive connection between the combined rotors 31, 41 and the drive shaft 14. This lead wobblestick 30 is therefor long (to reduce the angle between the longitudinal axis 36 of the wobblestick 30 and the longitudinal axis 39 of the drive shaft 14) and of a sizeable diameter (to handle the combined torque of both rotors 31, 41).

The secondary wobblestick 40 is the associate drive connection between the rotors 31, 41. This secondary wobblestick 40 is located axially in line with the axial centers 37, 47 of both rotors 31, 41. The wobblestick 40 is located in its operating position by an external locating flange 27 extending off of its center portion into a corresponding groove 28 in the porting member 21, a part of the housing 11. In the embodiment shown this groove 28 is created by indenting a circular section of the porting member 21 in respect to the two neighboring manifold plates 33, 43. [In the operation of the device the axial centers 37, 47 and the axis of the secondary wobblestick 40 move all together to define a phantom cylinder about the central axis of the device. (The central axis of the device is an extension of the longitudinal axis of the drive shaft 14 in line with the axial centers of the stators 32, 42 of the gerotor structures 12, 13).] The wobblestick 40 is therefor short and tightly fitted into the rotors 31, 41 and sized to transfer the torque of but the single rotor 41. Note that in the preferred embodiment shown the axial centers 37, 47 of the rotors 31, 41 trace equally sized circles about the axis of their respective stators 32, 42 and the gerotor structures 12, 13 are angularly oriented to provided for rotational congruence of the rotors 31, 41 in respect to the drive shaft 14 (i.e. the wobblestick 40 is and remains in line with the rotors 31, 41). For this reason one technically could make the preferred rotors 31, 41 and wobblestick 40 out of a single piece of machined steel. The relationship between the parts is that stable. In other embodiments of the invention the rotors could trace differing sized circles with or without rotational congruence to meet the actual or desired requirements of the particular application, in which case the wobblestick 40 may have to provide an angular compensation between rotors 31, 41.

The rotors 31, 41 are differentially sized and angularly oriented in respect to their stators to optimize their operation.

The rotors 31, 41 are differentially sized with similar diameters but with differing lengths. This reduces harmonics and other problems that would be associated with similar sized gerotor structures.

Figure 3:
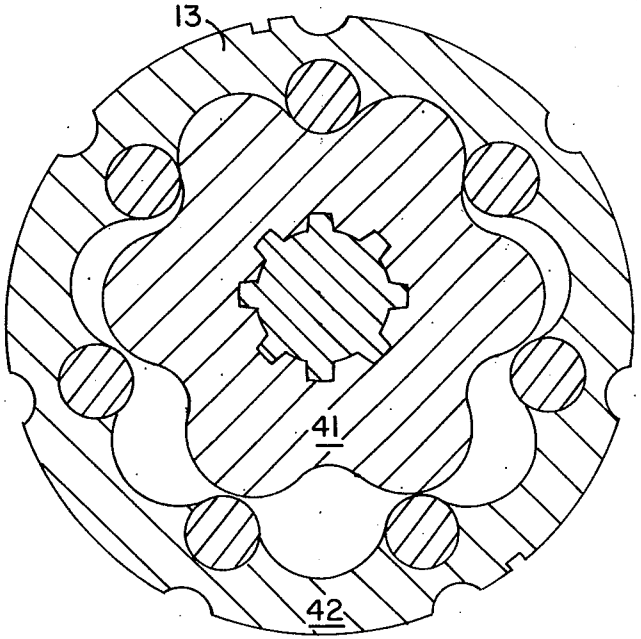
FIG. 3 is a widthwise cross-sectional view of the gerotor motor of FIG. 1 taken generally along lines 3—3 of that FIGURE.
Figure 2:
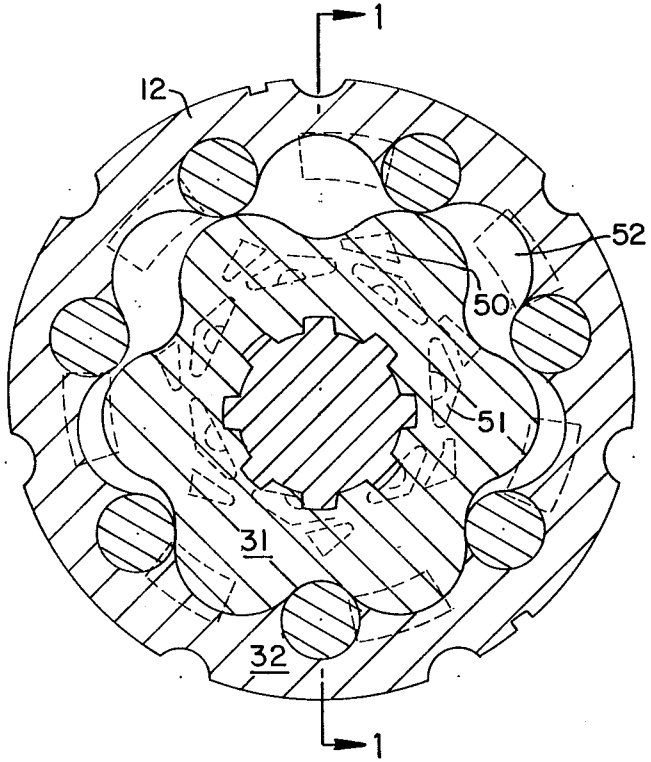
FIG. 2 is a widthwise cross-sectional view of the gerotor motor of FIG. 1 taken generally along lines 2—2 of that FIGURE.
Figure 5:
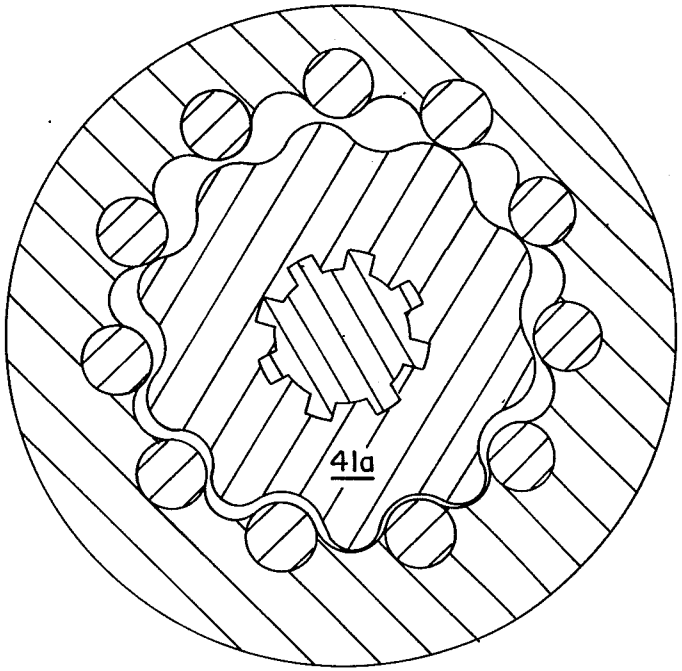
FIG. 5 is a widthwise cross-sectional view like FIG. 3 of a gerotor device with a different number of gerotor cells.

Each pair of rotor-stator 31–32, 41–42 are differentially angularly offset from the other to smooth the linearity of the output torque of the device and otherwise reduce stalling. To accomplish this the two gerotor structures 12, 13 are effectively rotated about 25 degrees in respect to each other [the total number of degrees (360) divided by the number of gerotor cells (in this instance 7) divided by the equalization/differentiation factor (in this case 2 for the number of gerotor sets)]. Either the rotors, stators or both can be varied to produce this angular relationship. In the embodiment shown both rotor and stator are varied so as to provide for angular congruence between the rotors 31, 41 and the drive shaft 14 (i.e. the rotors 31, 41 are both at the same o'clock orientation in respect to the drive shaft 14 at all times). Due to this angular relationship when one rotor, for example 31, has a full cell neutral phase orientation (shown in FIG. 2) the other rotor, for example 41 (shown in FIG. 3), still has a certain degree of rotation before reaching the equivalent full cell neutral phase orientation. The forces on the two rotors 31, 41 are therefor out of phase in respect to each other with neither peaking at the same point in time. This smooths the curve for the device. The key is to eliminate or minimize any points of minimum displacement in the cells in both gerotor structures at all times. This can be produced by altering the angular orientation of the rotors (as in FIG. 1), varying the number of lobes on the rotors (i.e. 6 lobes on rotor 31 and 11 lobes on rotor 41 as shown as 41*a* in FIG. 5), or otherwise.

The manifold plates 33, 43 are designed to match the angular orientation of their respective rotor-stator 31–32, 41–42 combinations.

The manifold plates 33, 43 are the main commutation/valving fluid connections for the device 10. These manifold plates are built of multi-plate construction. This construction and their operation are described in U.S. Pat. No. 4,474,544 issued Oct. 2, 1984. All openings are rotatively-oriented to match the angular offset of the respective gerotor structure 12, 13. The rotors 31, 41 single plane commutate and valve their respective gerotor structure 12, 13. This is preferred from the alternative of using one rotor to valve both gerotor structures (as could occur by connecting the gerotor cell openings of one manifold plate 33, 43 to the appropriate gerotor cells of both gerotor structures 12, 13 and eliminating the other manifold plate 33, 43). The fluid ports 25, 26 for both manifold plates 33, 43 are located on a porting member 21 betwwen the two manifold plates 33, 43. One fluid port connects directly to the centers 38, 48 of both rotors 31, 41. The other fluid port connects to the other valving groove 35, 45 of both rotors 31, 41 through openings 50 in the manifold plates 33, 43. Alternately, if independent gerotor structure operation is desired, each gerotor structure 12, 13 could have its own independent ports. This could be accomplished for example by switching the manifold plate 33 with the balancing plate 34 for the structure 12 and providing the additional ports in the housing 11 for the manifold plate 33. A series of openings 51 in the manifold are individually connected via passageways in the manifold to other openings 52 leading to the gerotor cells. As the rotor orbits the respective center 38, 48 of the rotor 31, 41 (one port) and the valving groove 35, 45 (the other port) selectively communicate with the series of openings 51 (and thus through openings 52 to the gerotor cells) to valve the device.

The balancing plates 34, 44 are designed to balance the high pressure feed of the single sided commutation and valving on the rotors 31, 41 respectively.

Each balancing plate 34, 44 is a thin, flexible steel plate fixedly connected at its outer edges to the housing 11 or its end plate 22. Each balancing plate covers a small pocket behind it which pocket is connected to the high pressure feed for the device through its respective rotor 31, 41. This is accomplished by including a small opening(s) leading to the pocket in the balancing plate in the area swept by the high pressure groove in the rotor. If the device is designed for bi-directional operation, small check valves are utilized to insure appropriate high pressure only connection (rather than alternate high-low pressure connection). The pockets could also be separately directly plumbed to a high pressure feed port 25, 26. The size of the pocket is designed to match the rotor's imbalance for the incoming high pressure. The balancing plate is described in detail in the U.S. patent application Ser. No. 798,301 filed Nov. 15, 1985 by Mr White.

Figure 4:
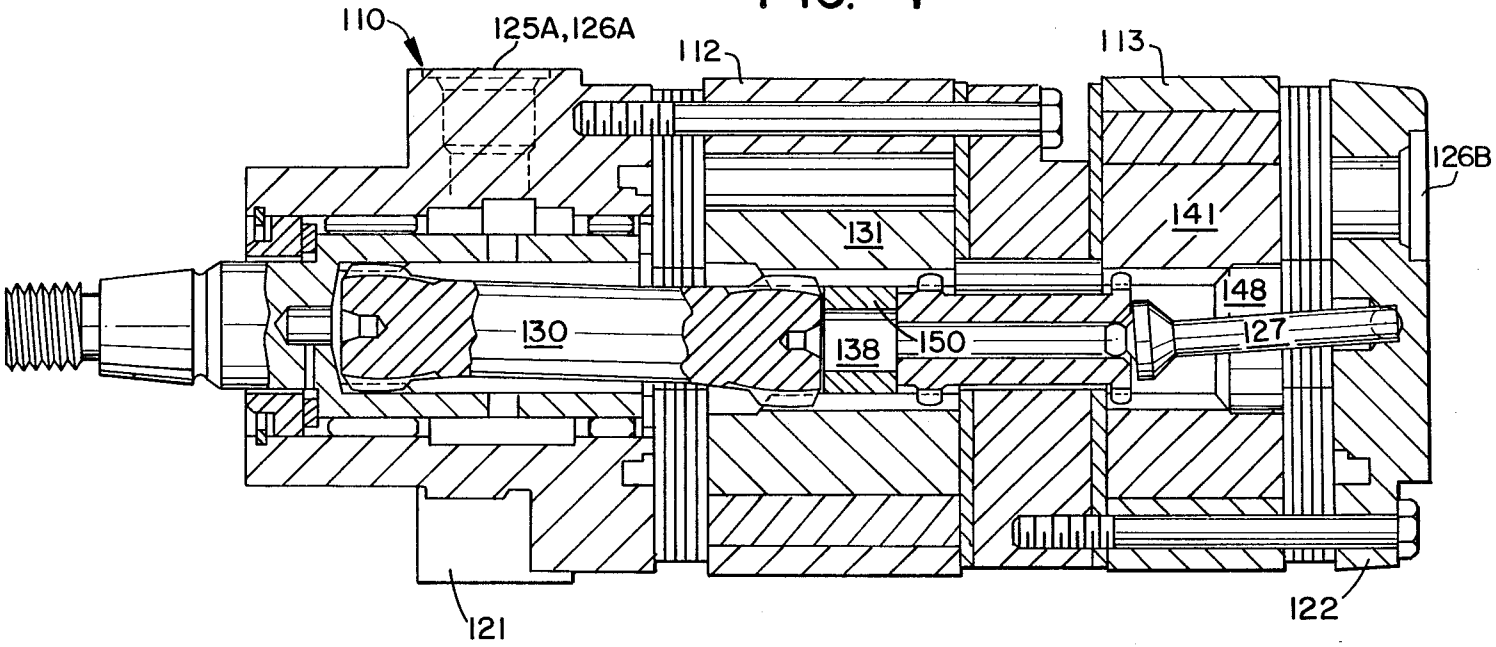
FIG. 4 is a central longitudinal cross-sectional view of an alternate gerotor motor incorporating the invention of the application.

The invention has been described in its preferred form with a certain degree of particularity. It is to be understood that numerous changes in the described embodiment may be had without deviating from the invention as claimed. For example as shown in FIG. 4, the parts can be repositioned to produce a totally unique device. In this modified device 110 there is a single port 125A connected to the centers 138, 148 of the rotors 131, 141. A blow-through ring 150 allows fluid through the rotor 131. This ring 150 also serves to pass locating forces from the pin 127 to the wobblestick 130. Each gerotor structure has its own other port—126A for the gerotor structure 112 in the housing 111 and 126B for the gerotor structure 113 in the end cover 122. This allows independent or unified operation of the gerotor structures 112, 113 through manipulation of the fluid connection to the ports 126A, 126B. In addition the wobblesticks 130, 140 are located in operating positions via a wobblestick locating pin 127 extending of of the end cover 122 and an intermediate blow-through ring member 150 between the two wobblesticks 130,140. Other changes are also possible without departing from the invention as hereinafter claimed.

What is claimed is:

1. In a device having two drive shaft connected gerotor structures, each having a rotor oriented with a certain fixed neutral phase relationship in respect to its stator, the improvement of the neutral phase relationship of one gerotor structure occurring at a different time than the neutral phase relationship of the other gerotor structure to smooth the linearity of the output torque of the device.

2. The improved device of claim 1 wherein each rotor traces a circle about the axis of its respective stator and characterized in that the diameter of the rotor-traced circles are substantially equal to each other.

3. The improved device of claim 1 wherein the gerotor structures are angularly oriented in respect to the drive shaft and characterized in that the gerotor structures are angularly oriented in respect to the drive shaft so as to provide for rotational congruence of the rotors of the gerotor structures.

4. The improved device of claim 1 wherein the neutral phase relationships each have a number of replications in a total 360 degree of circumference and characterized in that the neutral phase relationships of the gerotor structures are angularly offset from each other according to the formula $$360 \text{ degrees}/(x+y)$$

where x = the number of replications in 360 degree of circumference of one gerotor structure where y = the number of replications in 360 degrees of circumference of the other gerotor structure.

5. In a device having two drive shaft connected gerotor structures, each having a rotor oriented with a certain fixed neutral phase relationship in respect to its stator, each rotor tracing a circle about the axis of its respective stator, a wobblestick connecting the two rotors, the wobblestick having an axis, the improvement of the neutral phase relationship of one gerotor structure being different in respect to the neutral phase relationship of the other gerotor structure to smooth the linearity of the output torque of the device, the diameter of the rotor-traced circles being substantially equal to each other, and the axis of the wobblestick being substantially in line with the axis of the rotors.

6. The device of claim 5 wherein the wobblestick has a toothed drive connection to both rotors and characterized in that the toothed drive connection to both rotors allows substantially no angular offset between the axis of the rotors and the wobblestick.

7. In a device having two drive shaft connected gerotor structures, each having a rotor oriented with a certain fixed neutral phase relationship in respect to its stator and a number of cells, the improvement of the neutral phase relationship of one gerotor structure being different in respect to the neutral phase relationship of the other gerotor structure to smooth the linearity of the output torque of the device, and the number of cells of one gerotor structure being different than the number of cells of the other gerotor structure.

8. In a device having two drive shaft connected gerotor structures, each having a rotor oriented with a certain fixed neutral phase relationship in respect to its stator, with a wobblestick connecting one rotor to a drive shaft and another wobblestick connecting the two rotors, the improvement of the neutral phase relationship of one gerotor structure being different in respect to the neutral phase relationship of other other gerotor structure to smooth the linearity of the output torque of the device, and the wobblesticks having a differing torque carrying capacity.

9. The improved device of claim 8 characterized in that the torque carrying capacity of the wobblestick connecting one rotor to the drive shaft is greater than the torque carryng the capacity of the other wobblestick.

10. The improved device of claim 8 wherein in that the wobblesticks both have diameters and characterized in that the diameter of the wobblestick connecting one rotor to the drive shaft is larger than the diameter of the other wobblestick.

11. In a device having two drive shaft connected gerotor structures, each having a rotor oriented with a certain fixed neutral phase relationship in respect to its stator and a displacement, the improvement of the neutral phase relationship of one gerotor structure being different in respect to the neutral phase relationship of the other gerotor structure to smooth the linearity of the output torque of the device, and the displacements of the gerotor structures being different from each other.

12. In a device having two drive shaft connected gerotor structures, each having a rotor oriented with a certain fixed neutral phase relationship in respect to its stator, the improvement of the neutral phase relationship of one gerotor structure being different in respect to the neutral phase relationship of the other gerotor structure to smooth the linearity of the output torque of the device, the two gerotor structures having manifold plates, said manifold plates being located between the two gerotor structures, a porting member and said porting member being located between the two manifold plates fluidically connected to same.

13. In a device having a housing and two gerotor structures each having a rotor oriented with a certain fixed neutral phase relationship in respect to its stator, the rotors of the two gerotor structures being interconnected by a wobblestick having a body, the improvement of the neutral phase relationship of one gerotor structure being different in respect to the neutral phase relationship of the other gerotor structure to smooth the linearity of the output torque of the device, a wobblestick locating flange, said flange extending off of the body of the wobblestick, a groove in the housing of the device surrounding the wobblestick and said flange extending into said groove locating said wobblestick.

14. In a gerotor hydraulic device having a first wobblestick interconnecting a first rotor with a drive shaft and a second wobblestick interconnecting a second rotor to the first rotor, each wobblestick having a torque carrying capacity, the improvement in that the first wobblestick has a larger torque carrying capacity than said second wobblestick.

15. The gerotor hydraulic device of claim 14 wherein the torque carrying capacity of the first wobblestick is substantially twice the torque carrying capacity of the second wobblestick.

16. In a gerotor hydraulic device having a first wobblestick interconnecting a first rotor with a drive shaft and a second wobblestick interconnecting a second rotor to the first rotor, the first and second wobblesticks each having a cross-sectional area, the improvement of the first and second wobblesticks having a differing torque carrying capacity, and the cross-sectional area of the first wobblestick being substantially twice the cross-sectional area of the second wobblestick.

17. In a gerotor hydraulic device having a first wobblestick interconnecting a first rotor with a drive shaft and a second wobblestick interconnecting a second rotor to the first rotor, the first and second wobblesticks each having a cross-sectional area, the improvement of the first and second wobblesticks having a differing torque carrying capacity and the cross-sectional area of the first wobblestick being larger than the cross-sectional area of the second wobblestick.

* * * * *